US006444032B1

(12) United States Patent
Bamford

(10) Patent No.: US 6,444,032 B1
(45) Date of Patent: Sep. 3, 2002

(54) POWDER COATING METHOD AND APPARATUS

(76) Inventor: Brad Bamford, 11110 Sheppard Ave., Toronto, Ontario (CA), M1G 2B3

( * ) Notice: Subject to any disclaimer, the term of this patent is extended or adjusted under 35 U.S.C. 154(b) by 0 days.

(21) Appl. No.: 09/455,221

(22) Filed: Dec. 6, 1999

(51) Int. Cl.[7] ..... B05C 13/00
(52) U.S. Cl. ..... 118/500; 118/209; 118/503; 414/222.01
(58) Field of Search ..... 118/500, 503, 118/52, 54, 70, 209, 207, 210, 223, 230, 232, 236, 238–239; 211/89.01, 89, 96–98, 100–103; 248/682, 690, 691; 414/222.01, 225.1

(56) References Cited

U.S. PATENT DOCUMENTS

| | | | | | |
|---|---|---|---|---|---|
| 733,831 | A | * | 7/1903 | First | 118/56 |
| 1,109,314 | A | * | 9/1914 | Beausejour | 118/503 |
| 4,397,893 | A | * | 8/1983 | Bottoms | 427/319 |
| 5,231,726 | A | * | 8/1993 | McKenney et al. | 15/88.3 |

* cited by examiner

*Primary Examiner*—Richard Crispino
*Assistant Examiner*—Yewebdar T T
(74) *Attorney, Agent, or Firm*—Jenkens & Gilchrist A Professional Corporation

(57) ABSTRACT

A carriage for supporting a component to be coated includes a support assembly and a plurality of coupling means to releasably secure the component to the support assembly. A plurality of motion devices mounted on the support assembly provides for predetermined movement of the component during an application of a coating layer to the component while supported by the support assembly.

28 Claims, 14 Drawing Sheets

POWDER COATING METHOD AND APPARATUS

The present invention relates to a support assembly to suspend a component during the application of a coating layer to the component and a method of applying such a coating.

BACKGROUND OF THE INVENTION

The exposure of components to hostile environments, such as encountered by steel parts on seafaring vessels, results in an undesirable breakdown or corrosion of the surface of such components. In order to provide protection for the exterior surface of the component, when placed in a hostile environment, a protective layer is typically applied. In certain harsh conditions such as prolonged exposure to ultraviolet light, a breakdown of the protective coating over time can occur, particularly where the protective layers are of non-uniform thickness.

The most common way to apply this layer is in the form of a sprayed paint. A disadvantage of this system is that the spray coating may be hard to apply uniformly over a large surface area of complicated geometry. A discontinuous coating layer may result from the spray process if proper coverage is not provided. These discontinuities or inclusions could result in an accelerated breakdown of the coating when the coated component is exposed to the hostile environment.

An alternate method for applying the protective layer is to dip the component in liquid paint. This method can be used for larger components with more complicated geometry, but a paint container typically has a short life span due to the drying and subsequent caking of the liquid paint on an interior surface of the container. The subsequent required maintenance and wastage of the paint material reduces the economic feasibility of this method. Another disadvantage is that for more complicated component geometry, air pockets can be trapped in various regions of the component, which affect the continuous nature of the protective coating.

One way of addressing the wastage of paint and related environmental issues is to use a fluidized bed to expose a heated part to a coating medium consisting of solid particles, which is well known in the art. One disadvantage of this system is that it is difficult to produce a coating of uniform thickness on all surfaces of a component of complicated geometry. The fluidized coating material typically collects or wells on the top surface and in pockets of the component.

It is an object of the present invention to provide a method and apparatus to obviate and mitigate some of the above mentioned disadvantages.

SUMMARY OF THE INVENTION

According to one aspect of the present invention there is provided a carriage for supporting a component to be coated including a support assembly and a plurality of coupling means to releasably secure the component to the support assembly. A plurality of motion imparting devices are mounted on the support assembly to provide predetermined movement of the component during an application of a coating layer to the component while supported by the support assembly.

In a further aspect of the invention a method is provided for applying a coating to an exterior service of a component including the steps of releasably securing the component to a support assembly and transferring a quantity of heat to the component. The component is disposed in a coating station and a plurality of motion imparting devices are activated to move the component held by the support assembly in a predetermined fashion. The exterior surface of the component is exposed to a coating medium and once the coating has been applied to the component, the component is removed from the coating station and the motion devices are deactivated. When ready, the coated component is released from the support assembly.

In a further aspect, the invention provides a method of applying at least two coatings to an exterior surface of a component which includes the steps of transferring a quantity of heat to the component and disposing the component in a coating station. Once in the coating station, the exterior surface is exposed to a primary coating medium and then subsequently exposed to a secondary coating medium within a predetermined time period. A residual component of the quantity of heat is employed to facilitate the application of the secondary coating medium to the primary coated component.

In another aspect of the invention there is provided a hook for releasably securing a component to a frame, including both a hanger end for coupling the hook to the frame and attachment end for releasably securing the hook to the component. Both of the ends are interconnected by a middle portion. The attachment end includes a notch, a plurality of edge supports located on an exterior surface of the notch and a fastener to releasably secure the component to the edge supports when the component is disposed in the notch.

In a still further embodiment of the invention there is provided a method of employing a hook for releasably securing a component to a frame including the steps of coupling a first portion of the hook to an attachment position on the frame. A cam is engaged between the frame and the first portion of the hook to secure releasably the first portion to the attachment position. The component is placed in a second portion of the hook. The second portion of the hook is releasably secured to the component by means of a fastener.

BRIEF DESCRIPTION OF THE DRAWINGS

An embodiment of the invention will now be described by way of example only by the following drawings in which.

DESCRIPTION OF THE PREFERRED EMBODIMENTS

Figure 1:
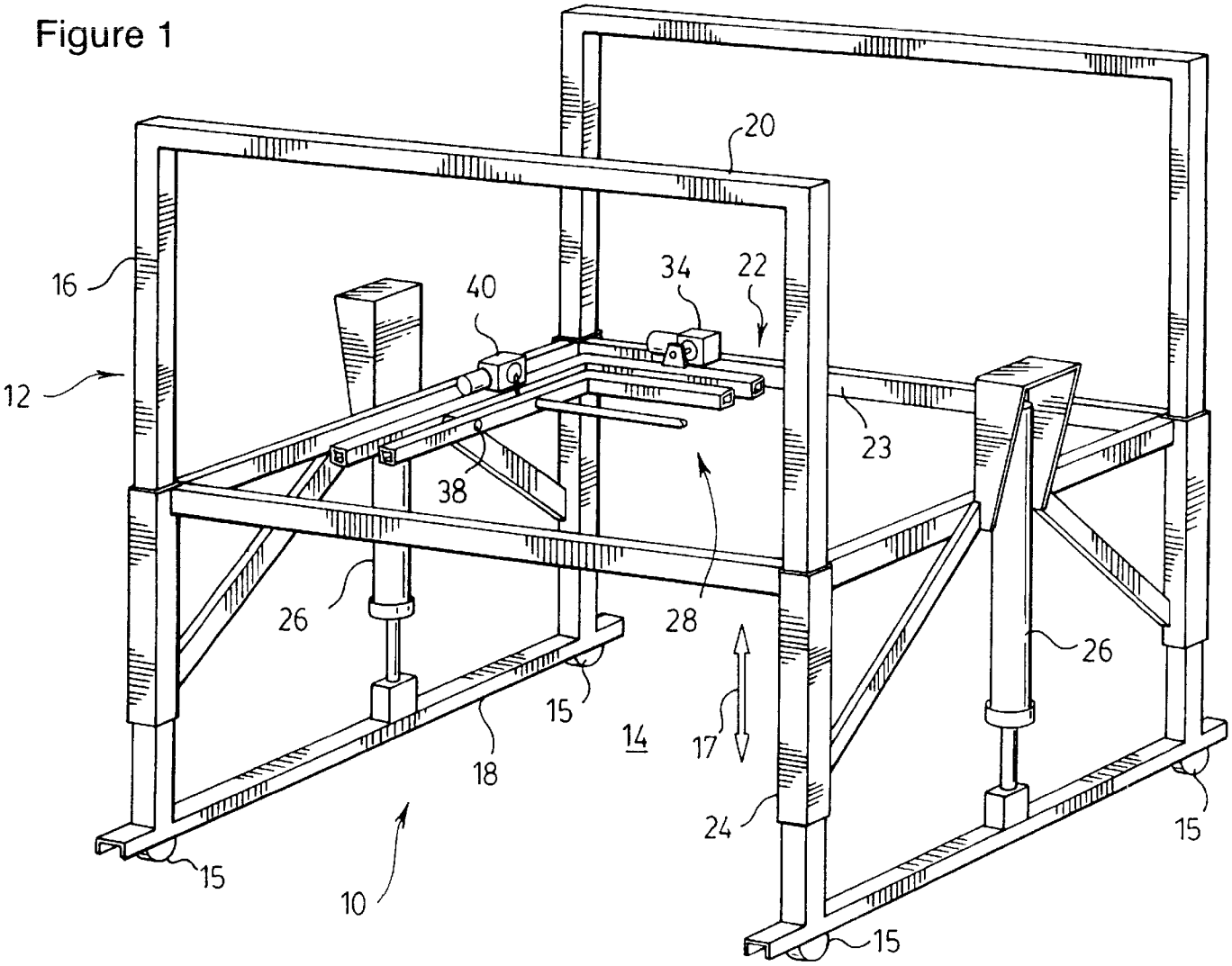
FIG. 1 is a perspective view of a carriage.

Referring to FIG. 1, a carriage 10 includes an upright frame 12, which is supported on a ground surface 14 by a set of wheels 15. The upright frame 12 has four legs 16 with cross members 18, 20 attached to the bottom and top of the legs 16 respectively. A platform 22 includes four side members 23, which are connected to the upright frame 12 by four sleeves 24. The sleeves 24 are welded to the platform 22 and are slidably connected to the legs 16, as indicated by the arrow 17. A double acting, hydraulic piston-cylinder actuator 26, is located at either end of the platform 22. These actuators 26 extend between the platform 22 and the upright frame 12 and act to vary the vertical position of the platform 22 with respect to the cross members 18. A sub-frame assembly 28 is coupled to the platform 22, which is shown in more detail in FIG. 2.

Figure 2:
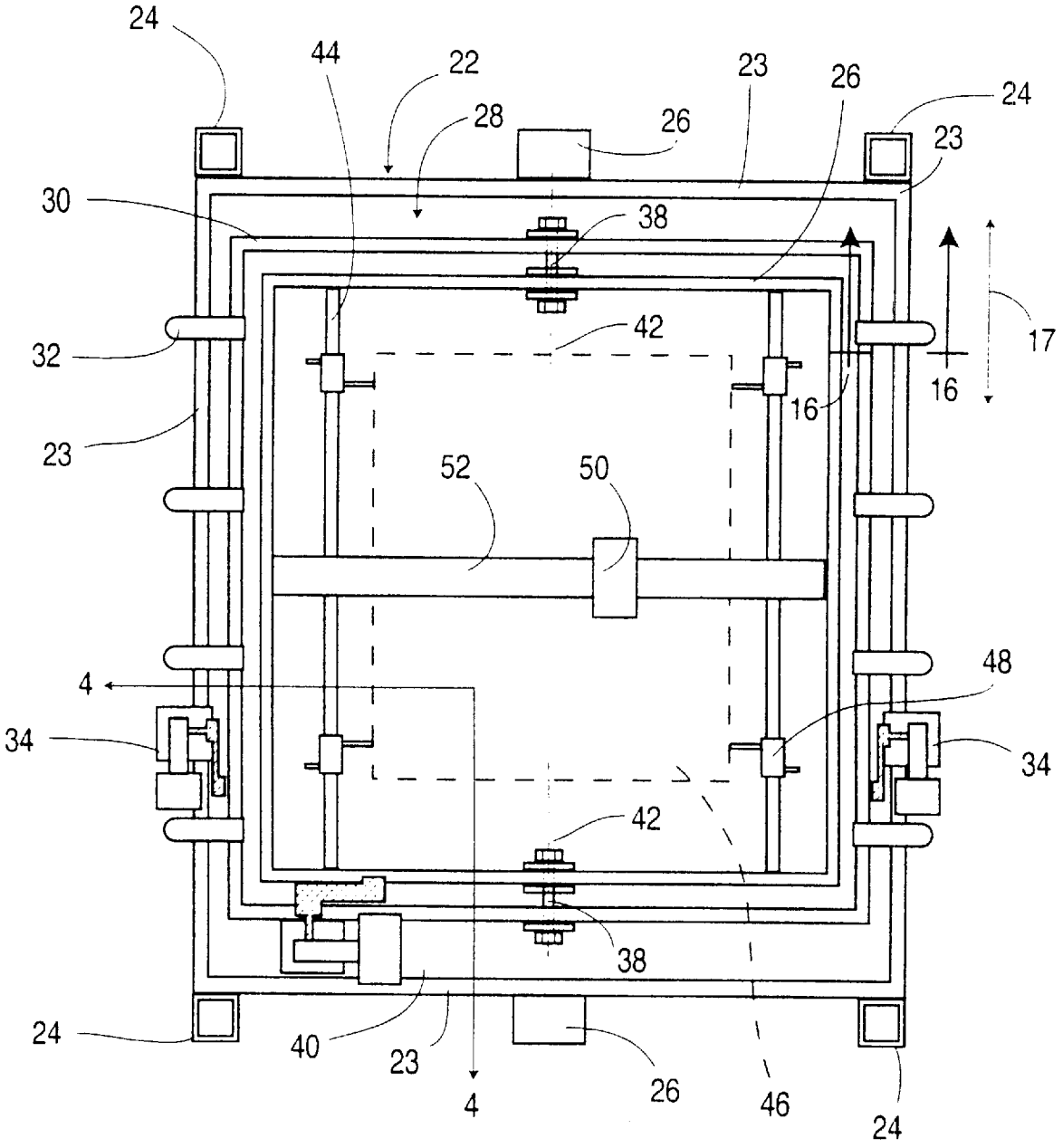
FIG. 2 is a planned view of a support assembly connected to the carriage of FIG. 1.
Figure 3:
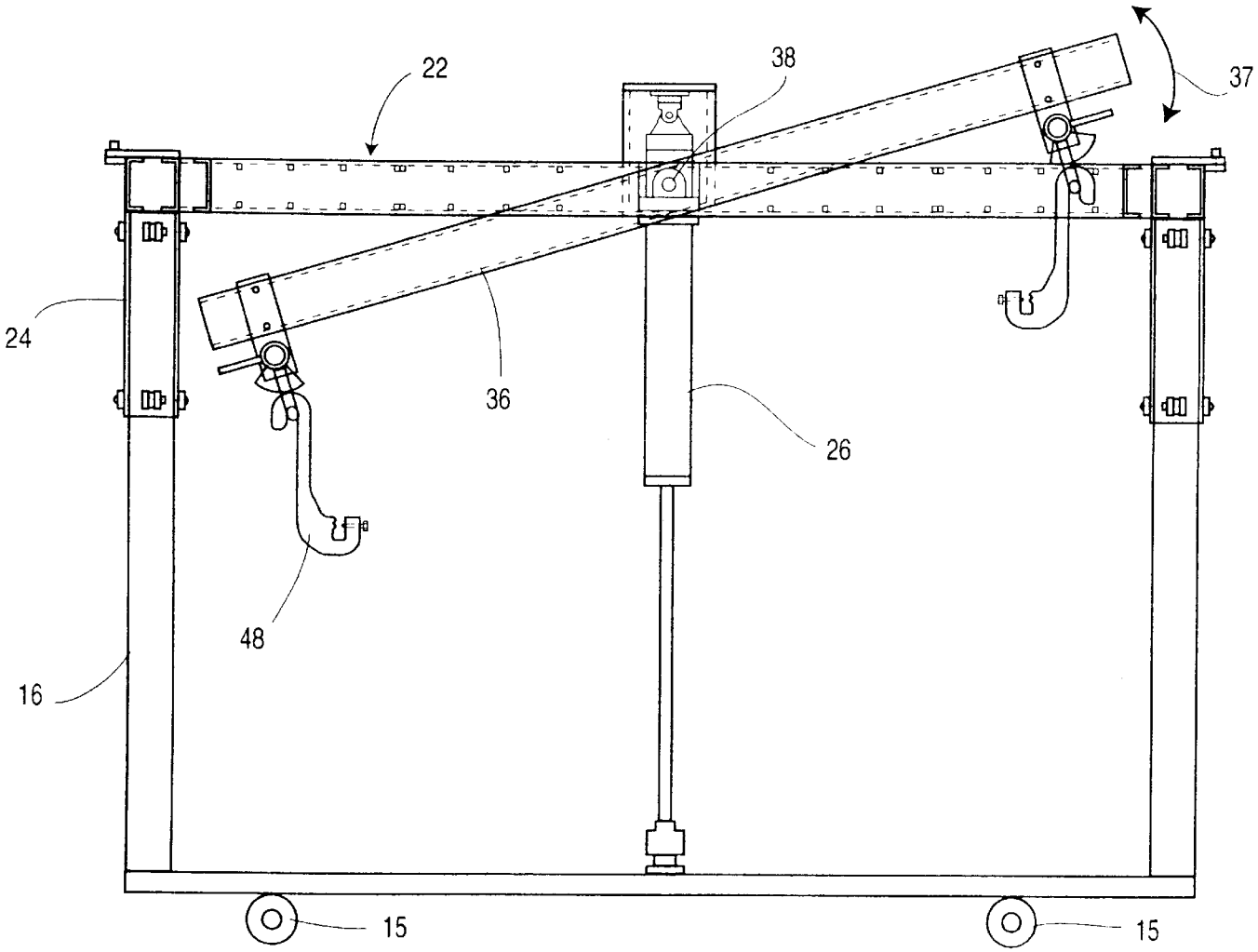
FIG. 3 is a side view of the support assembly of FIG. 2 mounted in the carriage of FIG. 1.
Figure 16:
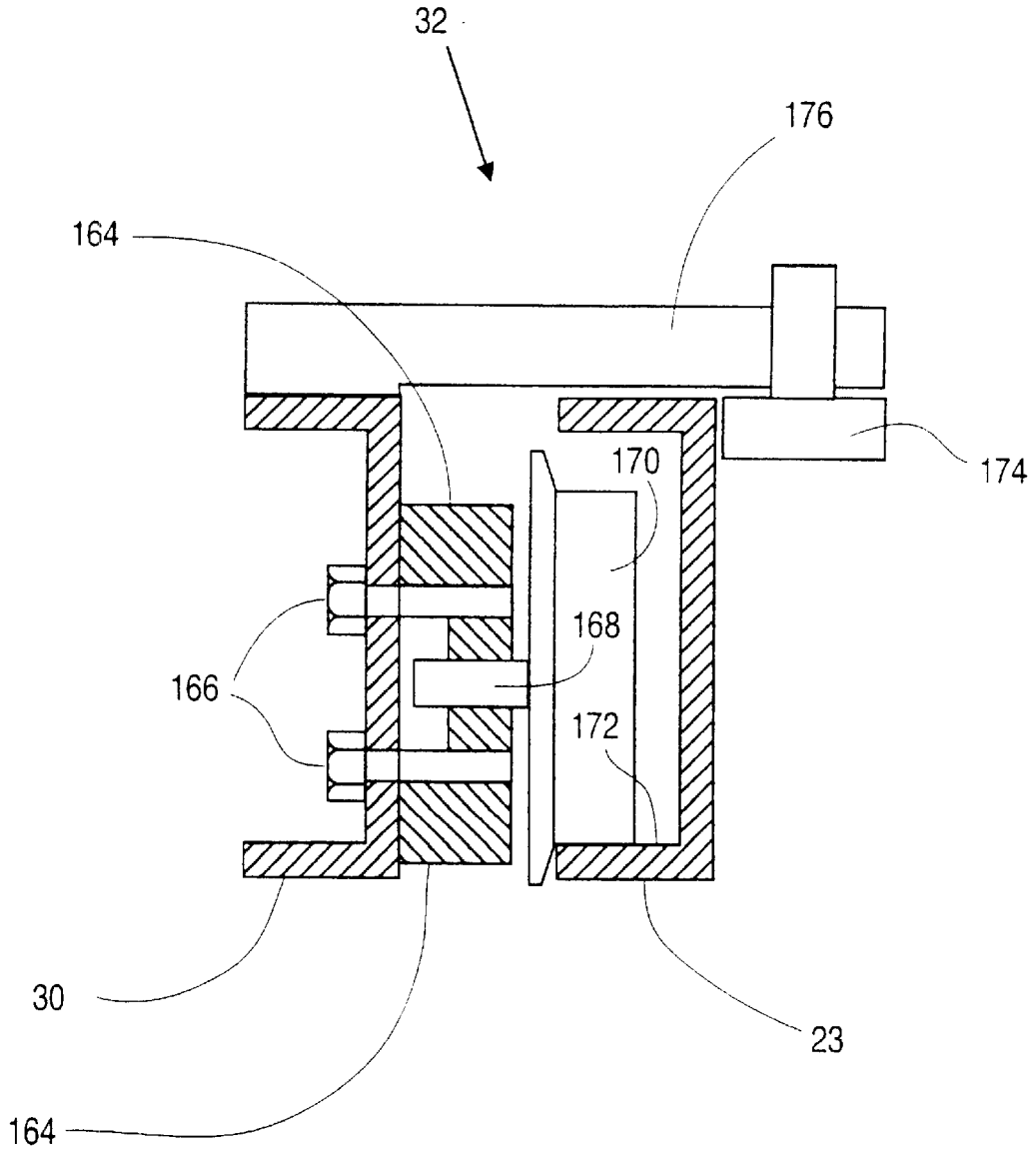
FIG. 16 is a section 16—16 view of the connection shown in FIG. 2.

As shown in FIGS. 2 and 3 the sub-frame assembly 28 includes a reciprocation frame 30. The frame 30 is coupled to the platform 22 with flexible connectors 32, which incorporate guides to retain the frame 30 in a horizontal plane defined by the side members 23. The connector 32, shown in FIG. 16, includes a set of spacers 164 bolted to the frame 30 by a pair of bolts 166. The spacers 164 support an axle 168, which in turn supports a wheel 170. The wheel 170 rests against a bottom inside surface 172 of the side members 23, along which the wheel 170 is permitted to travel in a reciprocal motion as indicated by arrow 173 of FIG. 2. A follower wheel 174 is supported on an arm 176, welded to the frame 30. The wheel 174 travels along an exterior surface 178 of the member 23, during reciprocation of the frame 30 with respect to the side members 23. Both wheels 170, 174 of the connector 32 act to retain a substantially parallel alignment of the frame 30 with respect to the side member 23 during relative reciprocation motion therebetween. Motorized reciprocation devices 34 are employed to displace the sub-frame assembly 28 in the horizontal plane, in the direction of arrow A.

A tilt frame 36 is attached to the reciprocation frame 30 by two pins 38. A motorized tilt device 40 is employed to tilt the frame 36 with respect to the frame 30, about a pivot axis 42 defined by the pins 38. The device 40 is offset from the pivot axis 42 and acts between the frame 30 and the frame 36 to produce the tilt motion indicated by arrow 37 (FIG. 3). A cross member 52 is welded to the tilt frame 36 on either side of the pivot axis 42. The cross member 52 supports a vibration device 50 to impart vibration to the platform 22 and components supported by it.

A pair of support rods 44 is also attached to the tilt frame 36 to extend the full length of the frame 36, on either side of the axis 42. A plurality of hanger assemblies 38 depend from the support rods 44 to suspend a component to be coated indicated at 46.

In the preferred embodiment of the present invention, the three devices 34, 40, 50 produce three modes of motion, namely reciprocation, oscillation and vibration, which are used during the application of a protective layer to the component 46. These motion modes help to distribute the coating uniformly and inhibit the formation of defects in the coating layer on the component, such as pinholes and non-uniform thickness, during the coating process.

Figure 4:
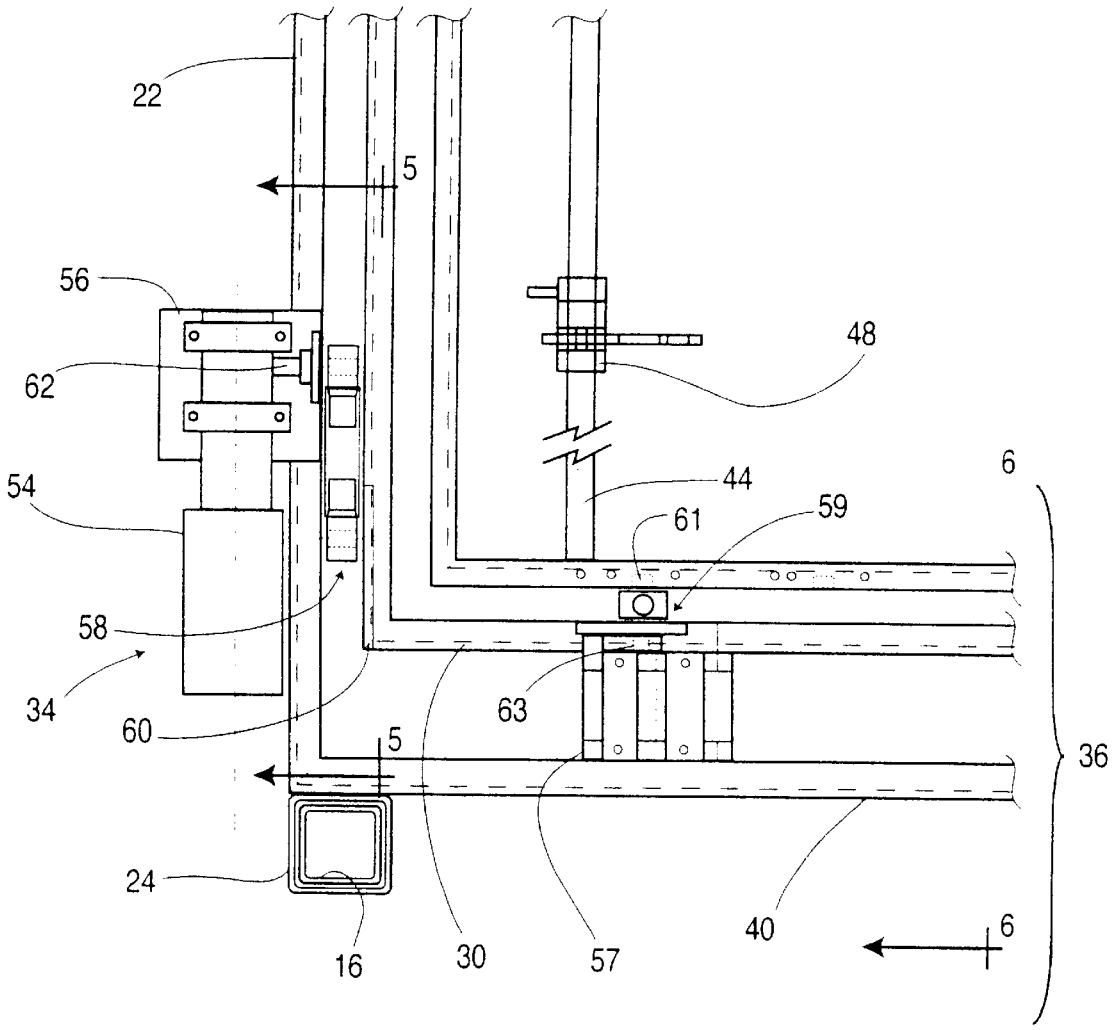
FIG. 4 is a view of section 4—4 of FIG. 2.
Figure 5:
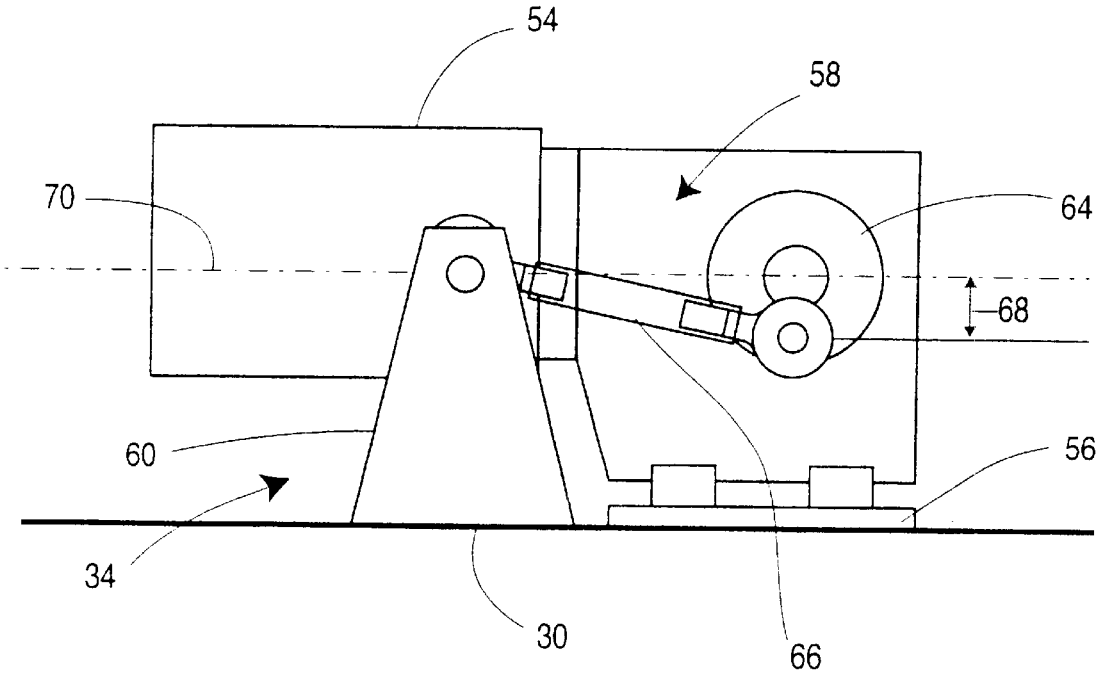
FIG. 5 is a section 5—5 view of FIG. 3.
Figure 6:
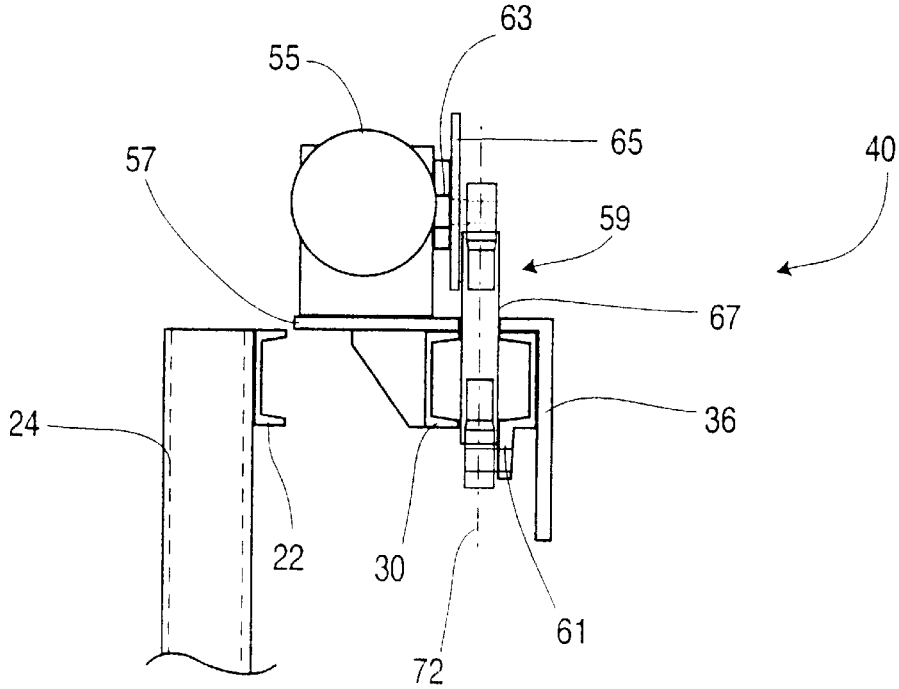
FIG. 6 is a section 6—6 view of FIG. 3.

As can be seen in FIGS. 4, 5 and 6, each of the motorized devices 34 and 40 includes an electric motor 54, 55 bolted to a base 56, 57 respectively. The base 56 of the device 34 is welded to the platform 22 and the base 57 of the device 40 is welded to the reciprocation frame 30. A crank assembly 58, 59 is connected at one end to the motor 54, 55 by a drive shaft 62, 63 respectively. The other end of the crank 58, 59 is connected by means of a pinned joint to a fixed arm 60, 61, which is mounted on each of the frames 30, 36 respectively. The crank 58, 59 includes a wheel 64, 65 attached to the drive shaft 62, 63 and a connecting rod 66, 67 coupled to the wheel 64, 65 respectively, by means of a pin joint radially off-set from the wheel center by a distance 68.

Rotation of the wheel 64, 65 causes the off-set distance 68 to be transferred along the connecting rod 66, 67 to the fixed arm 60, 61. In the case of the reciprocation frame 30, movement of the fixed arm 60 along a horizontal axis 70 causes the frame 30 to be displaced horizontally and reciprocate in the plane of the platform 22 under the guidance of the rollers 164. In the case of the tilt frame 36, movement of the fixed arm 61 along a vertical axis 72 causes the frame 36 to oscillate about the pivot axis 42 in a plane perpendicular to the platform 22. In addition to oscillating and reciprocating motion, activation of the vibration device 50 causes the sub-frame assembly 28 to vibrate. This vibration is transmitted from the assembly 28 to the component 46, through the support rods 44 and the hanger assemblies 48.

Figure 7:
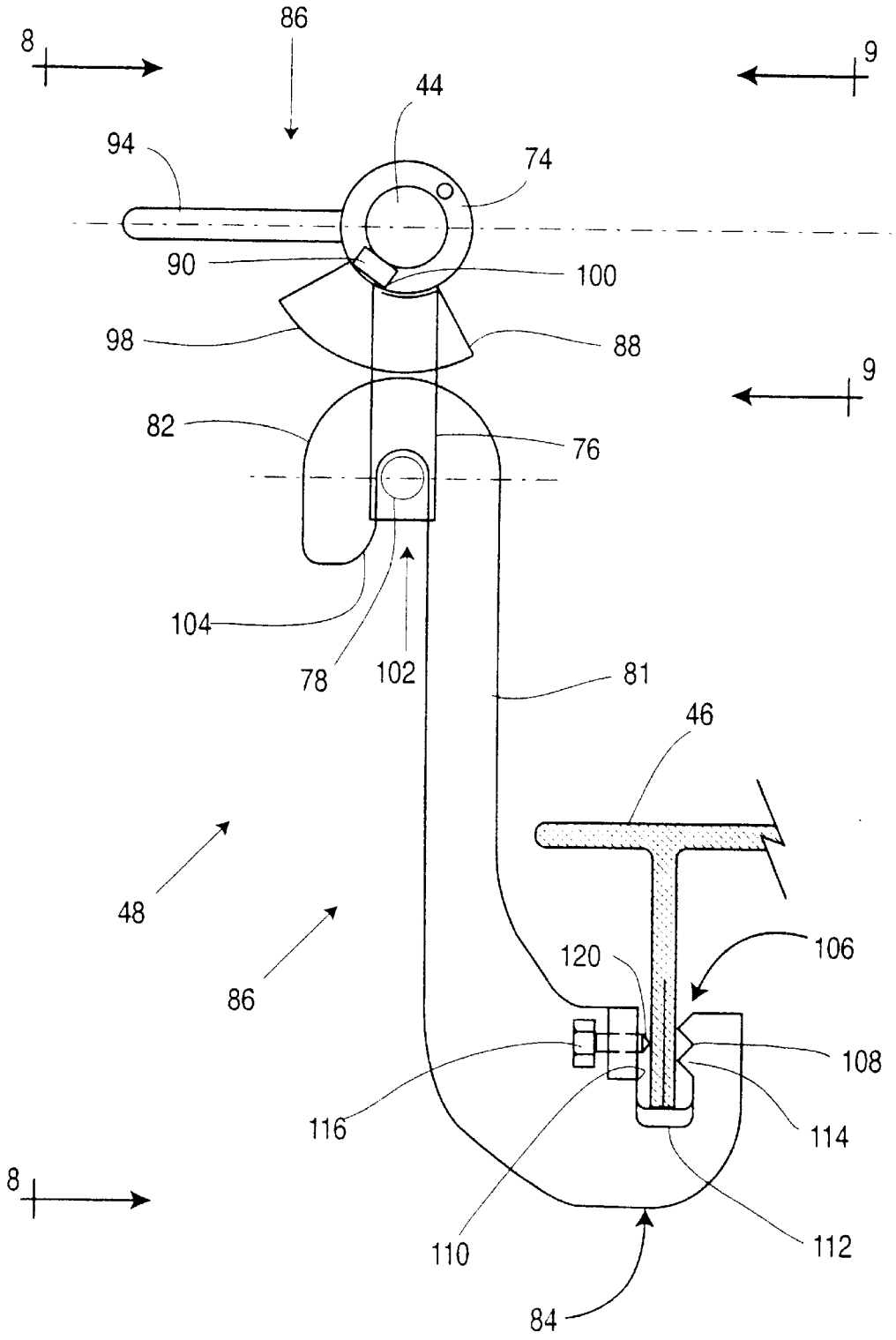
FIG. 7 is a side view of the hanger assembly of FIG. 3.

Referring to FIG. 7, the hanger assembly 48 includes a support sleeve 74. The support sleeve 74 is wrapped around the support rods 44 and may be free to move longitudinally along the rod 44, if desired. Adjacent to the sleeve 74 is a cam assembly 86, shown in more detail in FIGS. 8 and 9. The cam assembly 86 includes a cam 88 attached by a sidearm 90 to a ring 92, which is positioned around the support rod 44. A handle 94 is attached to the ring 92, which facilitates rotational and axial movement of the cam assembly 86 with respect to the rod 44. Circumferential movement of the sidearm 90 with respect to the sleeve 74 may be facilitated by a cut-out 96 in the sleeve 74.

A pair of support arms 76 depend from the sleeve 74 in a spaced relationship, with a support pin 78 extending between the arms 76. A hook 80 is supported by the pin 78 and includes a body 91 having a bight 82 at one end to engage the support pin 78. The bight 82 is arcuately shaped and contains an arcuate recess 102 of a diameter slightly larger than that of the support pin 78. A bevel 104 facilitates positioning of the recess 102 on to the support pin 78.

The opposite end 84 has an upwardly directed notch 106 to receive a portion of the component 46. The notch 106 has side surfaces 108, 110 and a bottom surface 112. The surfaces 108, 112 have a plurality of triangular ridges 114, which act to minimize the contact surface area between the hanger assembly 48 and the component 46. A pair of threaded fasteners 116 are positioned in holes 118. When the fasteners 116 are tightened, a tapered tip 120 contacts the component 46 and forces it against the ridges 114 on the side surface 108. The employment of the fastener 116 provides a secure connection between the component end 84 of the hook 80 and the component 46.

The length of the body 81 is dictated by the particular geometrical configuration of the component 46, in order to position the component 46 below the plane formed by the side members 23. The length of the body 81 may be adjustable, if desired.

Figure 8:
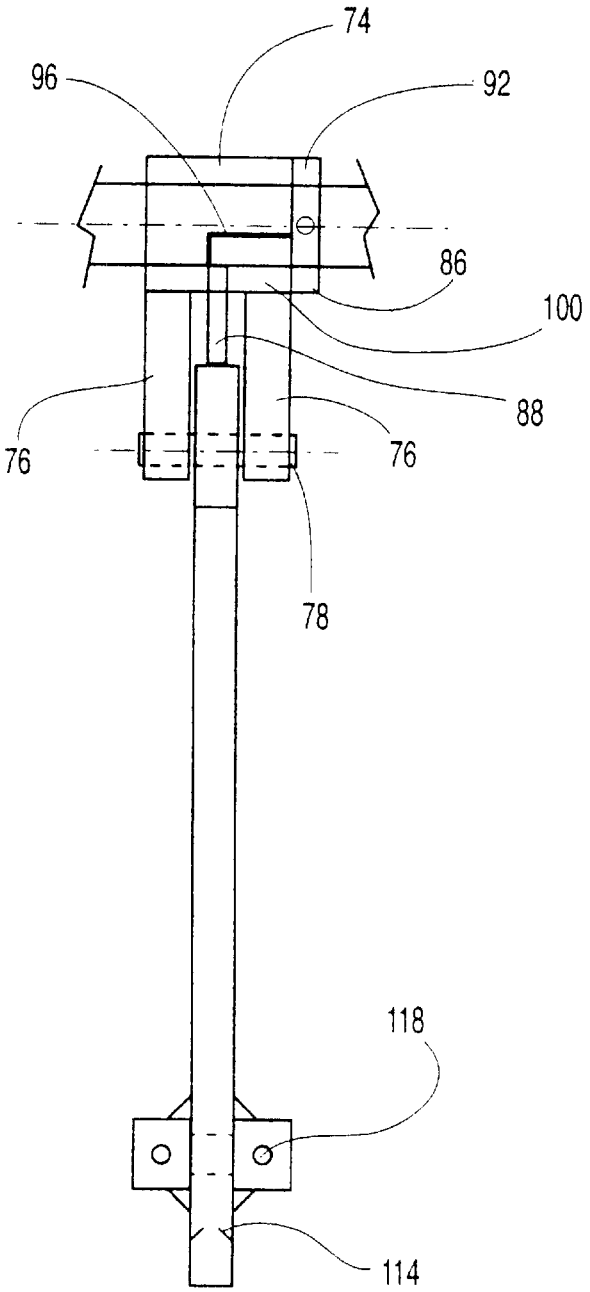
FIG. 8 is a view of section 8—8 of FIG. 7.
Figure 9:
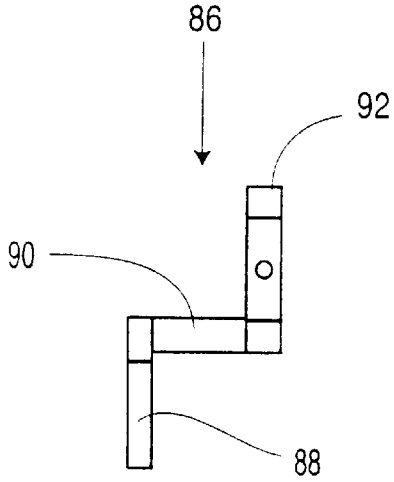
FIG. 9, is a view of section 9—9 of FIG. 7.

The cam assembly 86 is employed to position the cam 88 between the support arms 76 and its movement is limited by the sidearm 90 coming into contact with an abutment surface 100 located on the sleeve 74. In this position, as shown in FIGS. 7 and 8, a cam surface 98 restricts vertical displacement of the bight 82 of the hook 80 during movement of the subframe assembly 28. Once the cam 88 is positioned, the weight of the handle 94 keeps the sidearm 90 in positive engagement with the abutment surface 100 and the cam surface 98 adjacent to the support end 82 of the hook 80.

The secure connection provided by the notch 106 ensures retention of the component 46 by the platform 22 during the reciprocation and vibration motions provided by the devices 34, 40 and 50. The arcuate shape of both the cam 88 and the support end 82 helps to retain the relative adjacent positioning therebetween during operation of the devices 34, 40, and 50. This adjacent positioning inhibits vertical displacement of the hook 80 away from the support pin 78, which could result in premature dislocation of the component 46 from the support rods 44.

In operation of the carriage 10, each of the hooks 80 is hung on a support pin 78 and the cam assemblies 86 are engaged. The component 46 to be coated is placed in the notches 106 of the hooks 80 and secured to the hooks 80 by means of the fasteners 116, thereby suspending the component 46 in the subframe assembly 28 of the carriage 10. The carriage 10 is transported to an oven (not shown), wherein the component 46 is heated to a sufficient temperature to facilitate the adherence of the coating powder in a fluidized bed, which is well known in the art. The carriage 10 is subsequently transported and positioned over the fluidized bed, as shown at coating station 128 shown in FIG. 10. The motion devices 34, 40, 50 are activated and the actuators 26 are used to lower the platform 22, until the component 46 is completely emerged in the fluidized bed.

Inside of the fluidized bed the coating medium, in the form of a powdered solids, contacts the exterior surface of the component 46. Once the powder comes into contact with the heated surface of the component 46, the powder melts and forms a coating layer. The motion devices 34, 40, 50 help promote uniform distribution of the coating powder, over the surface of the component 46, during the coating process. Once the coating layer is of a sufficient thickness, the actuators 26 are used to raise the platform 22 out of the fluidized bed and the motion devices 34, 40, 50 are deactivated. The motion devices 34, 40, 50 may continue to function once the platform 22 is raised out of the fluidized bed in order to remove a build up of the powdered solids on various portions of the component 46. The carriage 10 may then be moved away from the fluidized bed and the coated component 46 is allowed to cool. Once the coated component 46 is cool enough to be handled, the fasteners 116 are loosened and the coated component 46 is removed from the hanger assemblies 48. The coated component 46 may be placed in a curing oven (not shown) once removed from the fluidized bed.

Figure 10:
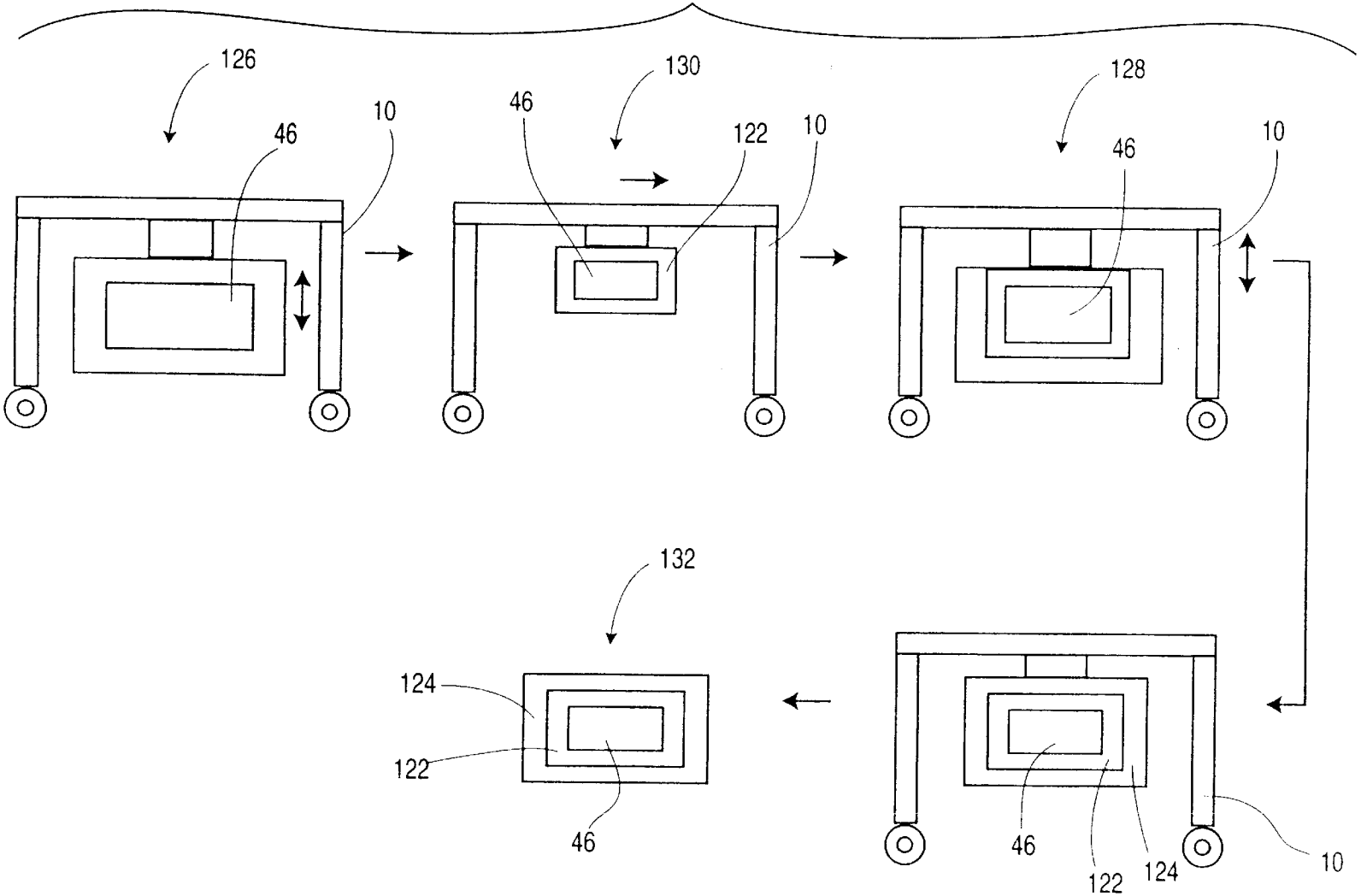
FIG. 10 is a schematic of a two layer coating process.

The apparatus described above is particularly useful for carrying out a novel coating process as shown schematically in FIG. 10. The carriage 10 is used to facilitate the application of two coating layers 122, 124, which may be of different physical and/or chemical properties, to the same component 46. After the component 46 receives the primary coating layer 122 in a primary coating station 126 as described above, the carriage 10 is transported 130 to a secondary coating station 128 and the coating process is repeated for the application of the secondary coating layer 124. The coating stations 126, 128 are preferably situated adjacent to one another so that a residual component of the heat originally supplied by the oven (not shown) to the component 46, is retained during transport 130 and is used to cause melting of the secondary powder to the primary coated component 46. In the preferred embodiment the first coat 122 is a zinc rich epoxy and the second coat 124 is a polyester based UV resistant top coat. The residual component of the heat facilitates cross-linking between the two coatings 122, 124, before the primary coating 122 has had time to cure. This process results in a double coated component 132.

An example of this embodiment is in the coating of large intake louvers for ships. The corrosion resistance of the louvers is provided mainly by the primary coating, such as grey zinc rich epoxy powder. The zinc content of the epoxy is preferably around sixty to-seventy percent by weight, which provides for resistance to undercreepage of the coating layer 122 in corrosive environments. The presence of zinc in the layer 122 also acts as a sacrificial element during the corrosion process. The secondary coating is a solid colour UV protectant layer for the zinc epoxy, such as Protec Z series polyester sold by Protec Chemicals, Montreal Canada.

In experiments using one tonne steel louvers, the louver 46 was heated for 30 minutes in a 400° F. oven. Upon removal from the oven, the surface temperature of the louver 46 was measured as between 160° F. to 190° F., based on a benchmark emissivity rating of 0.8 explained below. A time of approximately 2 to 2.5 minutes was taken to suspend the louver in the carriage 10 and position the louver over the first coating station 126. After a dwell time of approximately 4 seconds in the station 126, the primary coated louver 46 was transported to the second coating station 128. The transport time of the louver 46 between the stations 126,128 was approximately 35 to 45 seconds, which resulted in adherence of the UV protectant layer 124 to the zinc layer 122. After removal of the coated louver 46 from the secondary coating station 128, the surface temperature was measured at approximately 230° F. to 270° F. The ambient temperature of the louver 46 during transfer to the stations 126, 128 and the temperature of the fluidized beds was approximately 70° F. to 80° F.

The reason for the apparent increase in surface temperature of the louver 46 is due to the temperature recording method used. A non-invasive technique employing a laser thermometer, model RAYST8LXU Ranger ST3 sold by Raytek of California U.S.A., is consistently used to record the surface temperatures. This technique is based on a reference emissivity of 0.80 used to calibrate the laser thermometer. A difference in emissivity between the uncoated and coated component provides for the apparent increase in surface temperature of the louver 46 during the two stage coating process, opposite to what one would expect.

In reference to the above example, care should be taken to produce a fairly uniform surface temperature of the louver 46 upon removal from the oven. Hot spots on the louver 46, or an excess bulk temperature, may result in an undesirable buildup of the coating layer 122 on the louver surface. This buildup can cause in the coating layer 122 to separate from the steel surface and form blisters. As well, if the surface temperature drops too low during transfer of the louver 46 to the second coating station 128, the quality of the secondary layer 124 can also be affected.

Figure 11:
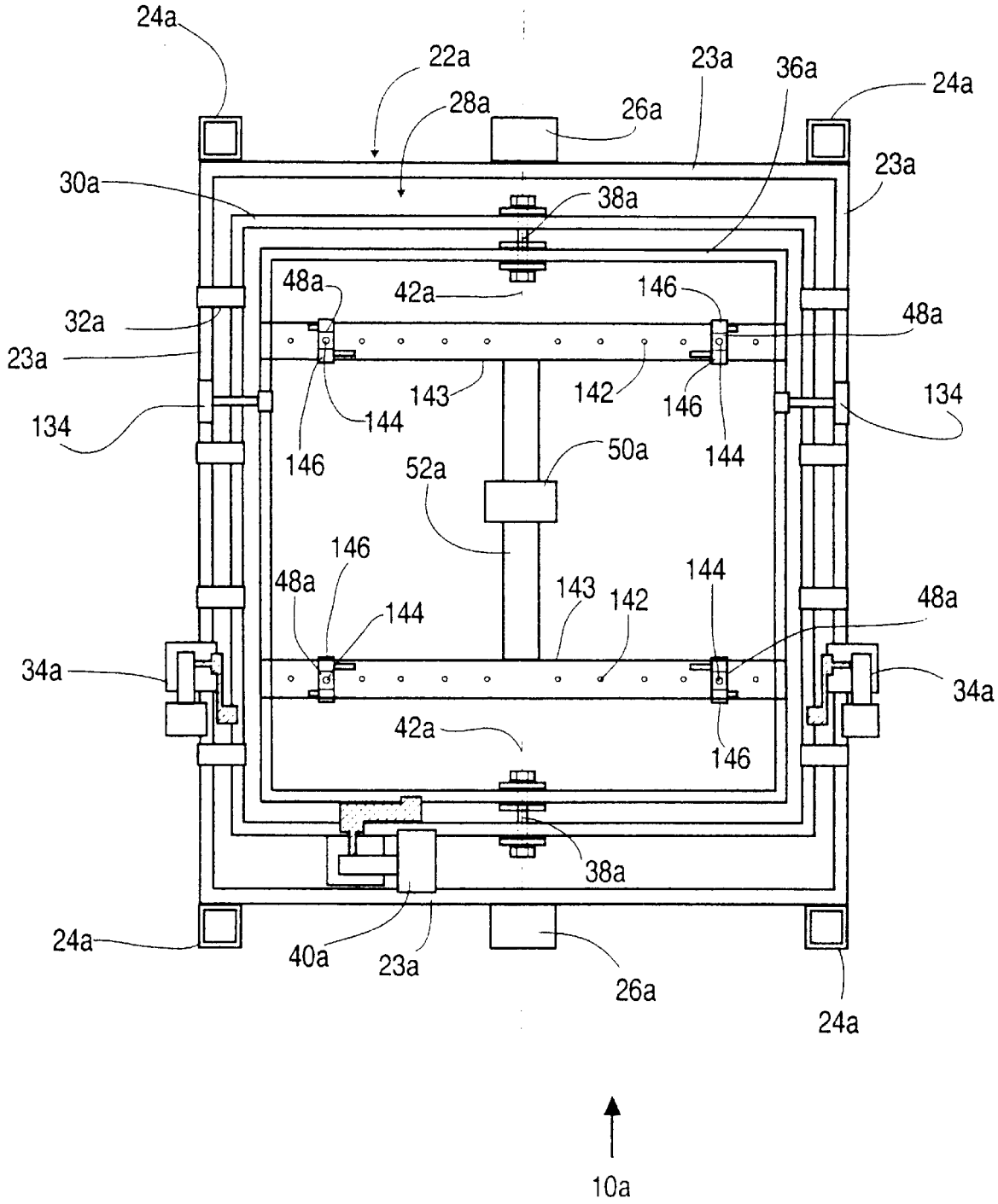
FIGS. 11 and 12 are plan view of a further embodiment of the carriage shown in FIG. 2.
Figure 12:
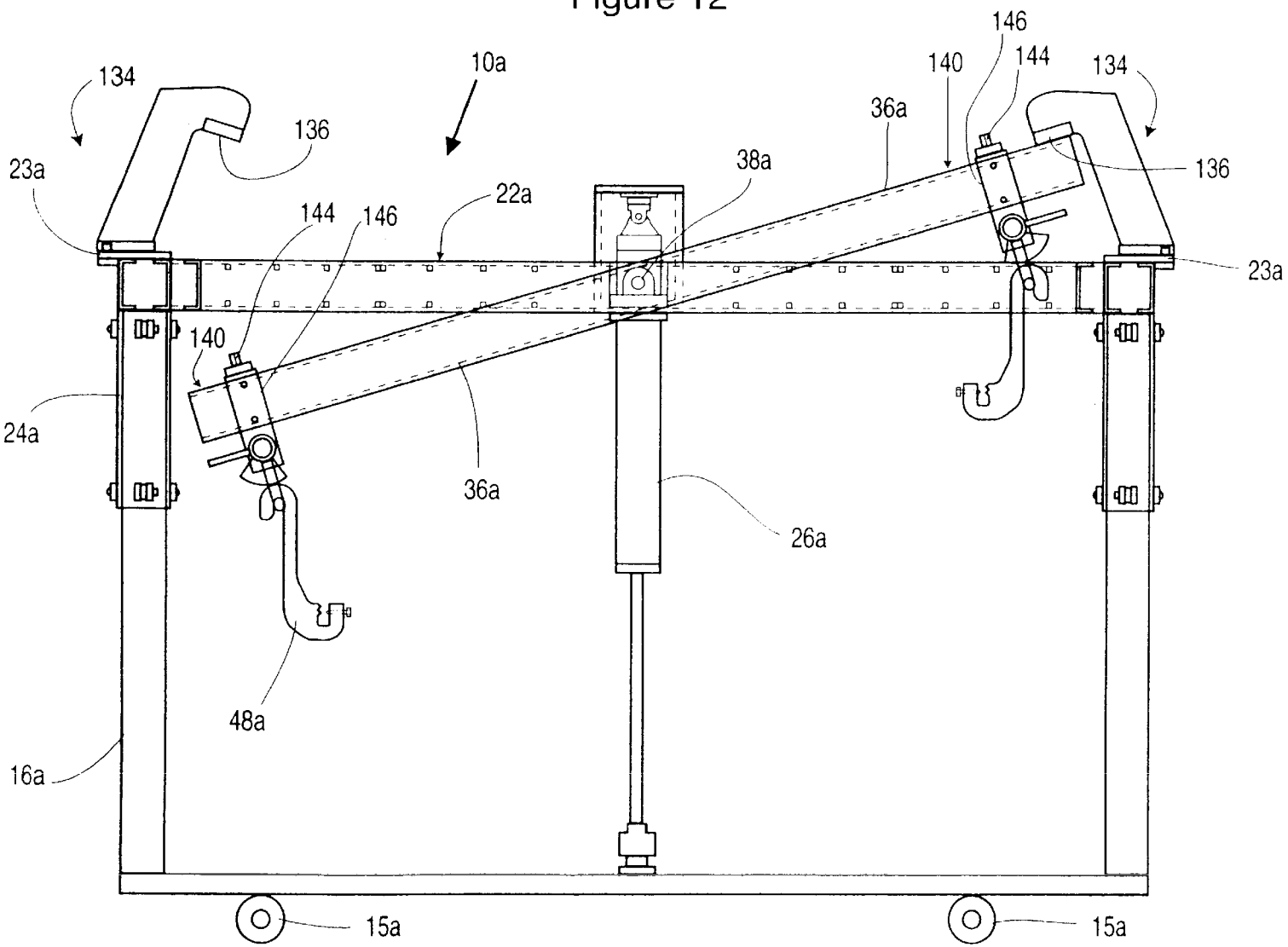

A further embodiment of a carriage 10*a* includes a pair of shock brackets 134 as shown in FIGS. 11 and 12, wherein like numerals with a suffix "a" refer to similar elements to those shown in FIG. 1. The bracket 134 has a reinforcement arm 138 bolted to the side member 23*a*. At the end of the member 23*a* is an impact surface 136. The impact surface 136 restricts the oscillating motion of the tilt frame 36*a* as the top surface 140 of the frame 36*a* contacts the surface 136. This impact or sudden shock resulting from the contact of the surfaces 136, 140 helps to displace excess coating powder off the exterior surface of the component 46 during operation of the carriage 10*a*. The surface 136 can be angled so as to be parallel with the surface 140, if desired.

The carriage 10*a* also has adjustment holes 142, located in a cross member 143, to permit variability in the position of a support bracket 146. The bracket 146 connects the support sleeve 74*a* of the hanger assembly 48*a* to the cross member 143. Referring to FIG. 12, a bolt 144 fastens the bracket 146 at a selected hole 142, in order to facilitate components 46 of various widths.

Figure 13:
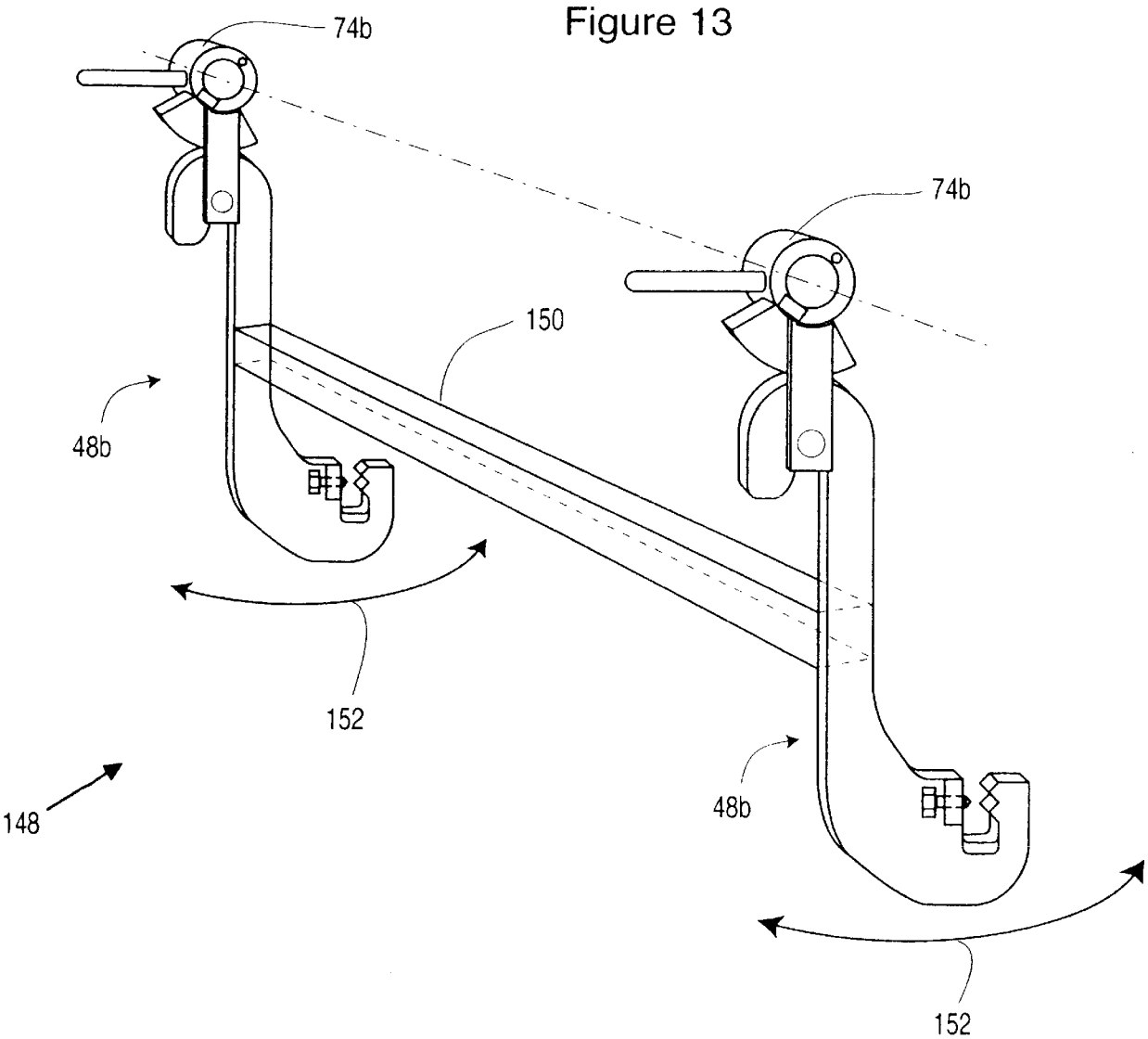
FIG. 13 is a further embodiment of the hanger assembly of FIGS. 7 and 8.

A further embodiment of the hanger assembly 48 is shown in FIG. 13, wherein like numerals with a suffix "b" refer to similar elements to those shown in FIG. 7. The hanger apparatus 148 has two hanger assembly 48*b* connected by a rigid support bar 150. The bar 150 helps to inhibit pivotal movement of the sleeves 74*b*, as indicated by arrows 152, during displacement of the sub-frame assembly 28 (not shown).

Figure 14:
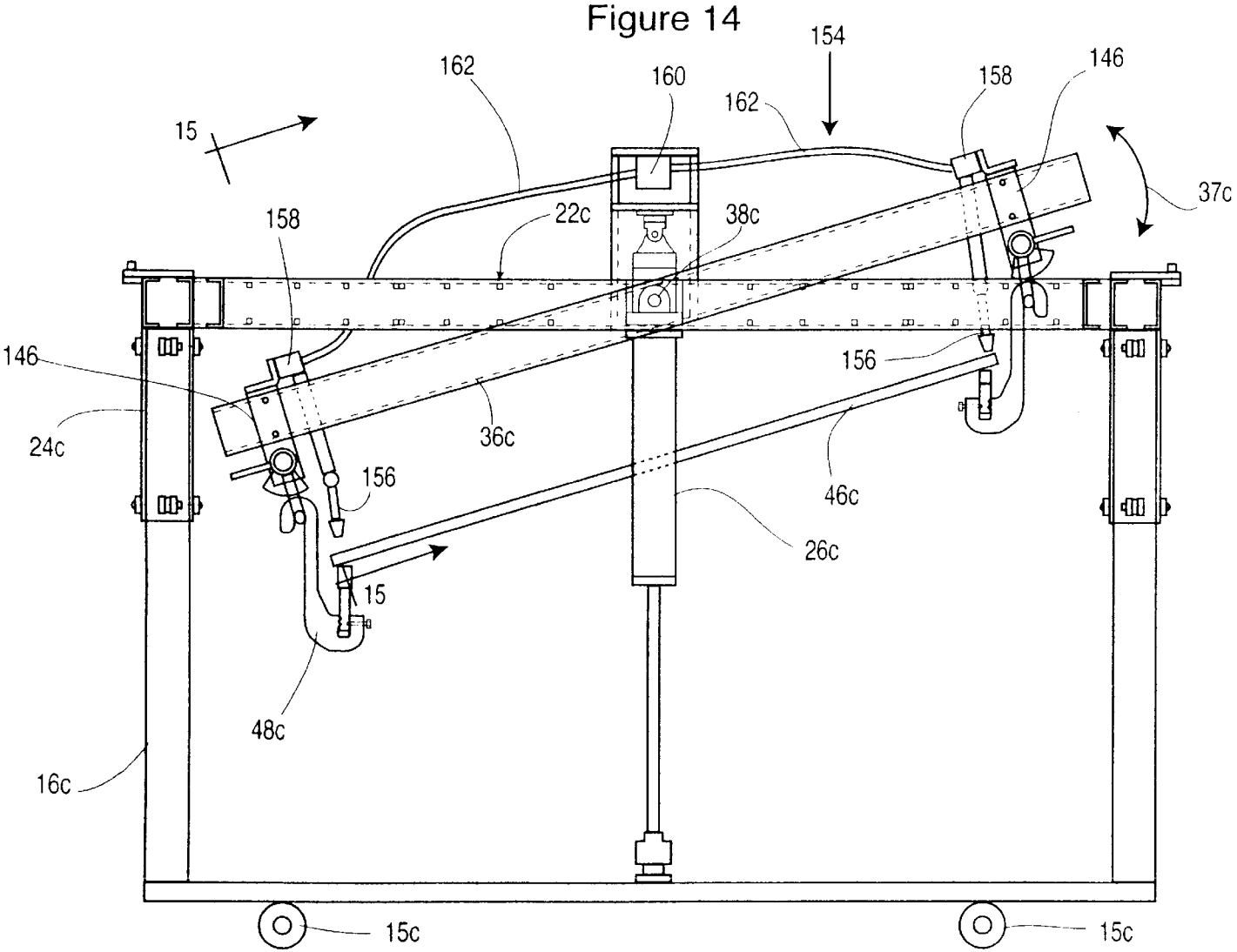
FIG. 14 shows a further embodiment of the carriage of FIG. 11.
Figure 15:
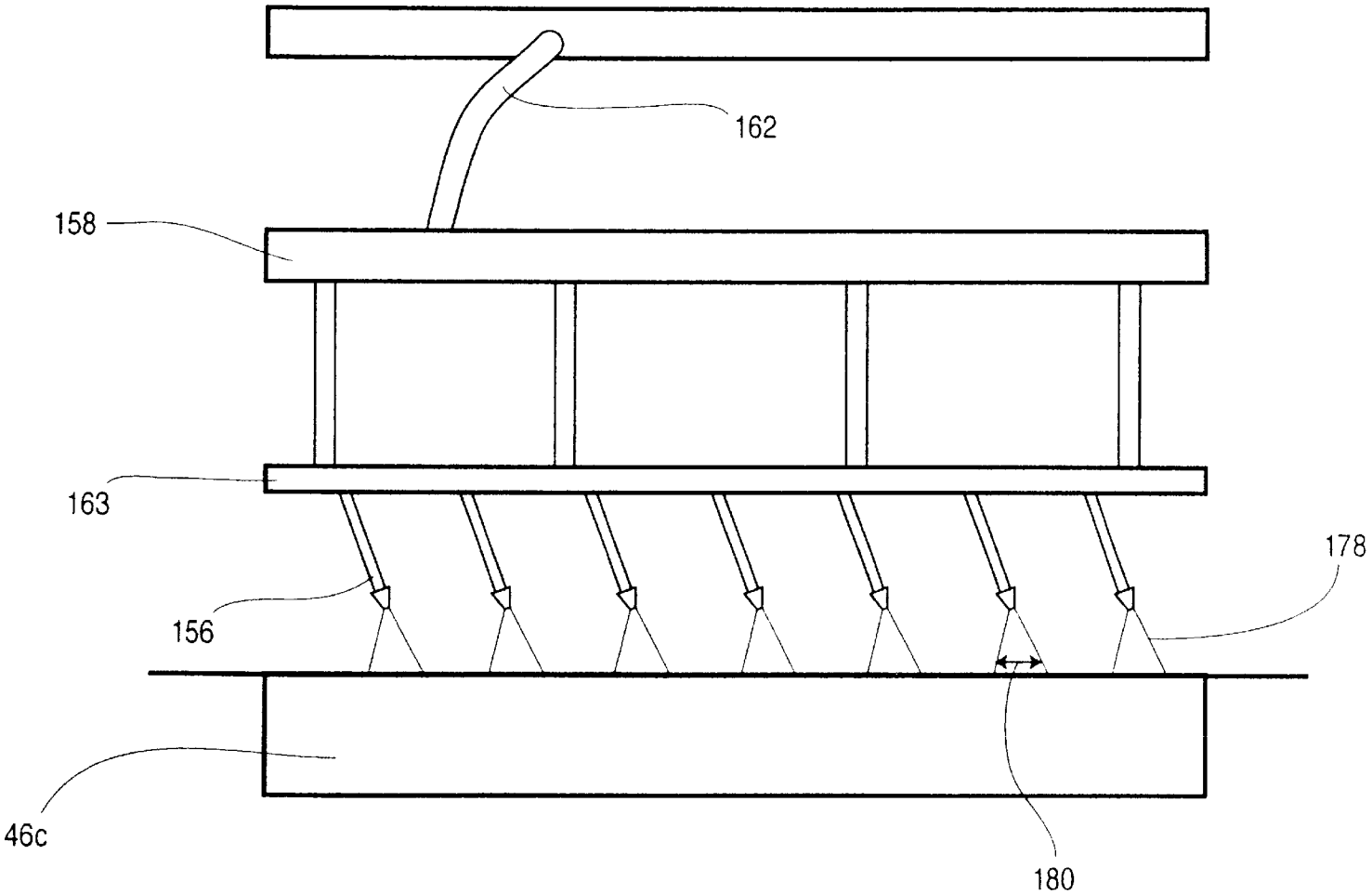
FIG. 15 is a section 15—15 view of the blower assembly of FIG. 14.

As shown in FIGS. 14 and 15, wherein like numerals with a suffix "c" refer to similar elements to those shown in FIG. 3, a blower assembly 154 is positioned adjacent to the component 46*c*. The blower assembly 154 includes a central plenum 160 connected to a pair of air manifolds 158 by a plurality of air hoses 162. The manifold is fastened to the bracket 146, which allows the blower assembly 154 to move with the brackets 146, when repositioned. A plurality of air nozzles 156 are distributed along the manifold 158 to direct air columns 178 towards the component 46*c*. The air columns 178 are employed to remove excess coating powder from the surface of the component 46*c*. At the base of the air column 178 is an air column footprint 180, which is located on the surface of the component 46*c*. The width of the footprint 180 can be broadened by canting the air nozzles 156 at an angle of approximately fourty five degrees with respect to a member 157.

It should be noted that the present invention may also be used in containers containing liquid paint and other paint application devices. It is recognized that different sized components 46, different coating mediums, and different oven temperatures will affect the dwell times, transfer times, and surface temperatures of the component 46 during the coating process. An example of other suitable coating mediums to be used in fluidized beds are nylon, PVCS, polyolefins, and polyurethane. The parts of the carriage 10, sub-frame assembly 28, and hanger assemblies 48 are preferably made of steel, aluminum, or other similar materials.

Although the invention has been described with reference to certain specific embodiments, various modifications thereof will be apparent to those skilled in the art without departing from the spirit and scope of the invention as outlined in the claims appended hereto.

MARAGARET A BOULWARE, Reg. No. 28,708, J. BENJAMIN BAL, Reg. No. 43,481, JEFFERY E. BACON Reg. No. 35,055, THOMAS L. CANTRELL Reg. No. 20,849, THOMAS L. CRISMAN Reg. No. 24,846, STUART D. DWORK Reg. No. 31,103, H. MATHEWS GARLAND Reg. No. 19,129, J. KEVIN GRAY Reg. No. 37,141, STEVENR. GREENFIELD Reg. No. 38,166, PAT HEPTIG Reg. No. 40,643, CRAIG A. HOERSTEN Reg. No. 38,917, JOHN R. KIRK JR. Reg. No. 24,477, ROGER L. MAXWELL Reg. No. 31,855, ROBERT A McFALL Reg. No. 28,968, LISA H. MEYERHOFF Reg. No. 36,869, STANLEY R MOORE Reg. No. 26,958, RICHARD J. MOLRA Reg. No. 34,883, MARKV. MULLER Reg. No. 37,509, P. WESTON MUSSELMAN JR Reg. No. 31,644, RICHARD A. MYSLIWIEC Reg. No. 40,098, J. L. JENNIE SALAZAR Reg. No. 45,065, JERRY R. SELINGER Reg. No. 26,582, ALAN R. THIELE Reg. No. 30,694, TAMSEN VALOIR Reg. No. 41,417, RAYMOND VAN DYKE Reg. No. 34,746, BRIAN D. WALKER Reg. No. 37,751, GERALD T. WELCH Reg. No. 30,332, and all members or associates of Jenkens & Gilchrist, A The embodiments of the invention in which an exclusive property or privilege is claimed are defined as follows:

1. A carriage for supporting a component to be coated including:

a support structure; sub-frame support assembly coupled to said structure; a plurality of coupling means to secure releasably said component to said sub-frame support assembly; a plurality of motion imparting devices to provide relative displacement between said structure and said sub-frame support assembly; a first device of the motion imparting devices providing a first mode of motion; and a second device of the motion imparting devices providing a second mode of motion dissimilar from the first mode of motion;

wherein a combination of the first and second modes of motion are applied during coating of the component.

2. A carriage for supporting a component according to claim 1, wherein the first and second modes of motion are selected from the group comprising reciprocation, oscillation, and vibration.

3. The carriage for supporting a component according to claim 2, wherein at least one of said plurality of motion devices is mounted on said sub-frame support assembly.

4. The carriage for supporting a component according to claim 1 further comprising a drive to vertically displace said sub-frame support assembly with respect to said structure.

5. The carriage for supporting a component according to claim 4, wherein said drive is a plurality of hydraulic actuators.

6. The carriage for supporting a component according to claim 1, wherein a plurality of wheels are positioned on said structure to permit movement of said carriage.

7. The carriage for supporting a component according to claim 2, wherein said sub-frame support assembly includes a first frame, a second frame, and a third frame.

8. The carriage for supporting a component according to claim 7, wherein said first frame is slidably coupled to said structure to permit relative displacement therebetween.

9. The carriage for supporting a component according to claim 8, wherein said first frame is coupled to said structure by a plurality of sleeves.

10. The carriage for supporting a component according to claim 7, wherein said second frame is reciprocally coupled to said first frame to permit substantially planar relative displacement therebetween.

11. The carriage for supporting a component according to claim 7, wherein said third frame is pivotally coupled to said second frame for rotation about an axis.

12. The carriage for supporting a component according to claim 1, wherein said component is releasably secured to said sub-frame support assembly by a plurality of hanger assemblies, the hanger assemblies are individually operable for coupling said component to said sub-frame support assembly at a plurality of locations.

13. The carriage for supporting a component according to claim 12, wherein said hanger assemblies are inhibited from vertical displacement with respect to said sub-frame support assembly once installed.

14. The carriage for supporting a component according to claim 2 further comprising an abutment surface to restrict the displacement of said sub-frame support assembly, wherein the action of restricting the displacement by said abutment surface facilitates the distribution of a coating material on said component.

15. The carriage for supporting a component according to claim 1, wherein a blower mechanism including a plurality of nozzles is employed to remove an excess amount of a coating medium from a surface of said component, the blower mechanism coupled to said sub-frame support assembly for following the position of the component during the relative displacement.

16. The carriage for supporting a component according to claim 15, wherein at least one of said plurality of nozzles is positioned nonorthogonally with respect to said surface of said component.

17. A carriage for supporting a component to be coated including: a structure; a sub-frame support assembly coupled to said structure; a plurality of hanger assemblies to secure releasably said component to said sub-frame support assembly; said sub-frame support assembly including a plurality of frames; a plurality of motion devices are provided on said plurality of frames to permit relative displacement between said structure and said component; a first device of the motion imparting devices providing a first mode of motion; and a second device of the motion imparting devices providing a second mode of motion dissimilar from the first mode of motion; wherein a combination of the first and second modes of motion are applied during coating of the component.

18. The carriage for supporting a component according to claim 17, wherein the first and second modes of motion are selected from the group comprising reciprocation, oscillation, and vibration.

19. The carriage for supporting a component according to claim 18, wherein said plurality of frames includes a first frame, a second frame, and a third frame.

20. The carriage for supporting a component according to claim 19, wherein said first frame is slidably coupled to said structure to permit relative displacement therebetween.

21. The carriage for supporting a component according to claim 19, wherein said second frame is reciprocally coupled to said first frame to permit substantially planar relative displacement therebetween.

22. The carriage for supporting a component according to claim 19, wherein said third frame is pivotally coupled to said second frame for rotation about an axis.

23. The carriage for supporting a component according to claim 19 further comprising a drive to vertically displace said sub-frame support assembly with respect to said structure.

24. The carriage for supporting a component according to claim 23, wherein said drive is a plurality of hydraulic actuators.

25. A carriage for supporting a component during a surface treatment applied to the component, the carriage comprising: a support structure; a sub-frame support assembly coupled to said structure, said sub-frame support assembly slideably coupled to said structure by a plurality of sleeves to permit relative displacement therebetween; a coupling to secure releasably said component to said sub-frame support assembly; and a plurality of motion imparting devices to provide relative displacement between said structure and said sub-frame support assembly.

26. A carriage for supporting a component for facilitating a surface treatment of the component, the carriage comprising: a support structure; a sub-frame support assembly coupled to said structure, said sub-frame support assembly including a first frame and a second frame; a coupling to secure releasably said component to said sub-frame support assembly; a plurality of motion imparting devices to provide relative displacement between said structure and said sub-frame support assembly; said second frame being reciprocally coupled to said first frame to permit substantially planar relative displacement therebetween.

27. A carriage for supporting a component for facilitating a surface treatment of the component, the carriage comprising: a support structure; a sub-frame support assembly coupled to said sub-structure, said sub-frame support assembly including a first frame a second frame a coupling to secure releasably said component to said sub-frame support assembly; a plurality of motion imparting devices to provide relative displacement between said structure and said sub-frame support assembly; said second frame being pivotally coupled to said first frame for rotation about an axis.

28. A carriage for supporting a component for facilitating a surface treatment of said component, the carriage comprising: a support structure; a sub-frame support assembly coupled to said structure, said sub-frame support assembly including a plurality of intercoupled frames; a coupling to secure releasably said component to said sub-frame support assembly; a plurality of motion imparting devices to provide relative displacement between said structure and said sub-frame support assembly; and a drive to vertically displace said sub-frame support assembly with respect to said structure.

* * * * *